US006608986B2

(12) United States Patent
Bartscher et al.

(10) Patent No.: US 6,608,986 B2
(45) Date of Patent: Aug. 19, 2003

(54) DIGITAL PRINTING OR COPYING MACHINE AND PROCESS FOR FIXING A TONER ON A SUBSTRATE

(75) Inventors: Gerhard Bartscher, Köln (DE); Gerald Erik Hauptmann, Bammental (DE); Frank-Michael Morgenweck, Molfsee (DE); Kai-Uwe Preissig, Dortmund (DE); Peter-Alexander Püschner, Schwanewede (DE); Domingo Rohde, Kiel (DE)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 10/023,384

(22) Filed: Dec. 17, 2001

(65) Prior Publication Data

US 2002/0154928 A1 Oct. 24, 2002

(30) Foreign Application Priority Data

Dec. 22, 2000 (DE) ..... 100 64 568
Jul. 23, 2001 (DE) ..... 101 35 788

(51) Int. Cl.[7] ..... G03G 15/20
(52) U.S. Cl. ..... 399/336; 219/216; 399/334
(58) Field of Search ..... 399/336, 335, 399/334, 337, 320; 219/216, 388; 347/156; 430/124, 97

(56) References Cited

U.S. PATENT DOCUMENTS 4,963,943 A * 10/1990 Tamary ..... 399/335
5,526,108 A * 6/1996 Billet et al. ..... 399/336 X
5,716,750 A * 2/1998 Tyagi et al. ..... 430/124
5,961,864 A * 10/1999 Nakajima et al. ..... 219/216
6,466,750 B2 * 10/2002 McIntyre ..... 399/334 X
2002/0088799 A1 * 7/2002 Behnke et al. ..... 399/336 X

FOREIGN PATENT DOCUMENTS

DE 33 17 416 A1 11/1984 ..... G03G/15/20
GB 20 18 199 A 10/1979 ..... G03G/15/20
JP 2001-117402 * 4/2001

* cited by examiner

*Primary Examiner*—Sophia S. Chen
(74) *Attorney, Agent, or Firm*—Lawrence P. Kessler

(57) ABSTRACT

A digital printing or copying machine (1), and a process which can be carried out with it, for one-sided or double-sided printing of a substrate (5) using at least one toner are proposed. The machine (1) includes at least one fixing device (3) for fixing of a toner image (29) on the substrate (5), having at least one heater (21, 23) for melting the toner image (29), past which the substrate (5) can be guided by a transport device (11) which has one or more transport elements (29, 63 to 71). The machine (1) is characterized in that the heater (21, 23) has at least two melt areas (31, 33, 43 to 47) on the substrate (5) which viewed in the substrate transport direction (15) are arranged in succession and laterally offset to one another.

8 Claims, 4 Drawing Sheets

DIGITAL PRINTING OR COPYING MACHINE AND PROCESS FOR FIXING A TONER ON A SUBSTRATE

FIELD OF THE INVENTION

The invention relates to a digital printing or copying machine for one-sided or double-sided printing of a substrate using a process wherein at least two melt areas on the substrate are arranged in succession and laterally offset to one another.

BACKGROUND OF THE INVENTION

Digital printing or copying machines work, for example, using the electrographic process, in which a latent electrostatic image is developed by charged toner particles. The latter are transferred to an image receiving substrate, hereinafter the substrate for short. Then the developed image, which has been transferred to the substrate, is fixed by the toner particles being heated and melted thereon. To melt on the toner particles, contact making methods are often used, in which the toner particles are brought into contact with the heater, for example hot rollers or drums. The disadvantage here is that generally it is necessary to use silicone oil as the separating agent which is designed to prevent adhesion of the melted toner to the heater. Furthermore, building and maintaining these contact making heaters are complex and thus operating costs are high. In addition, the fault rate caused by the contact making heaters is relatively high. To fix the toner which has been transferred for example to paper, furthermore noncontact heaters and processes are known, in which for example the toner particles are melted using thermal/microwave radiation or hot air.

In the contact making and noncontact melt on processes, for example toners are used which have a glass transition temperature (TG) which is in the range from 45° C. to 75° C. The glass transition temperature at which the toner, proceeding from the solid state, begins to become soft, can be influenced by the choice of raw materials and by adding certain additives to the toner. In a fixing device which has at least one heater for the toner, both the toner and also the substrate itself are heated. To be able to ensure good fixing of the toner on the substrate, the surface temperature of the substrate must be in the area of the glass transition temperature of the toner or above. The toner reaches or exceeds the glass transition temperature ($T_G$) in the area of the heaters.

Printing and copying machines are known in which the substrate is printed on both sides, for printing of the front and back the same image generating and transfer device and heater or one separate image generating and transmission device and heater at a time being used. To fix the toner image, the substrate is often guided past at least one image generating and transfer device and the assigned heater using a transport belt on which the substrate lies. First of all, a first toner image is transferred to the first substrate side and fixed. Then a second toner image is transferred to the second substrate side and fixed. When the second toner image is melted, therefore the first substrate side with the already fixed first toner image located on it adjoins the transport belt. The disadvantage here is that while the second toner image is being melted, the first toner image can be heated to such an extent that it becomes soft and tends to stick to the transport belt. This can lead to several undesirable effects: The sticking can lead to problems in the transfer of the substrate from the transport belt to a following part of the machine until the substrate piles up. Furthermore, the appearance of the toner image can change in the areas in which it has adhered to the transport belt. This leads to problems in image quality, for example, the toner image has a nonuniform gloss.

SUMMARY OF THE INVENTION

The object of the invention is to devise a machine and a process in which double-sided printing of a substrate with simultaneously high quality of the toner images applied to the front and back of the substrate is possible.

To achieve this object, a digital printing or copying machine is proposed which has at least one fixing device which is used for fixing of a toner image which has been transferred to the substrate. The toner image can be monochrome or polychrome. In conjunction with this invention, a "toner image" is also defined as a coating which has at least one toner image. The substrate can for example be a sheet or continuous web which consists of paper or cardboard. To fix the liquid or dry toner on the substrate, it is routed past at least one heater which is part of the fixing device. To move the substrate in the area of the heater along the transport path there is a transport device which has several transport elements. The printing or copying machine of the invention is characterized in that the heater has at least two melting areas on the substrate, which viewed in the substrate transport direction are located in succession and laterally offset to one another. The toner image is therefore not completely melted and fixed in one process, but at least two component melting processes take place in which only one strip of the toner image which has a certain width is melted at a time. This makes it possible to arrange the transport elements distributed around the melt areas of the heater. This means that there are no transport elements or other guide elements which come into contact with the top and bottom of the substrate in the melt areas of the heater. If therefore when the first toner image which has been transferred to the top of the substrate is melted there should be a first toner image which has been fixed in a preceding treatment process on the bottom of the substrate and which can be heated to such an extent that it remelts, the second toner image cannot stick anywhere since, as stated, it has no contact with the surface. Until the first and/or second toner image comes into contact with the transport element or another surface, it is cooled to such an extent that there will be no adverse effect on the image quality or sticking of the substrate on this surface. Because the substrate has no contact with the surface in the area in which a part/section of the toner image is melted, a high quality of the toner images which have been applied to the front and back of the substrate can be ensured. Sticking of the toner images to a surface, for example to a transport element, is essentially precluded, since contact only occurs when the toner image is in the solid state again.

In conjunction with this invention the "melt area" of the heater is the area or the surface of the toner image which can be melted using the heater. The melt area, viewed in the substrate transport direction, has a width which is smaller than the total width of the toner image. Therefore simply one strip shaped toner image section is melted, not the entire toner image, by the heater. If the heater is formed for example by a radiation device which exposes the toner image to electromagnetic radiation, the melt area of the radiation device on the substrate is that part of the toner image which is melted by the radiation.

According to one development of the invention, it is provided that the melt areas overlap one another on the toner image to be fixed. Overlapping of the melt areas is preferably relatively little so that a toner image section/strip as small as possible is melted several times. The overlapping of the melt areas ensures that for a lateral offset of the substrate which has been displaced in the transport direction, in fact the toner image is also melted over the entire width and no unfixed toner image areas remain. Alternatively it is also possible for the melt areas not to overlap one another on the toner image to be fixed, so that the toner is not repeatedly melted.

The heater which the toner image is melted without contact, i.e., without mechanical contact, exposes the toner image to thermal and/or microwave radiation and/or hot air or steam. It is easily possible to implement several melt areas at a distance from one another on the toner image using only one heater. To do this the thermal/microwave radiation or the hot air must accordingly be applied specifically to the toner image. In another embodiment of the invention, the fixing device has at least two heaters which can preferably be controlled independently of one another and which each have at least one melt area on the substrate. Of course, it is also possible for one separate heater at a time to be used for each of the melt areas on the substrate.

To achieve this object, a process is furthermore proposed in which first of all a first toner image is transferred to the first side of the substrate and the substrate is routed past the first melt zone of a fixing device of the digital printing or copying machine in which the process is used. In the first melt zone a first toner image section is melted, i.e. a lengthwise strip of the toner image which viewed in the substrate transport direction has a width which is preferably smaller than the entire width of the toner image. By moving the substrate along its transport path it travels from the first melt zone into a following, second melt zone in which the second part of the toner image is melted. Therefore, several melting processes take place, only over one section/strip of the toner image at a time being heated to such an extent that the toner becomes liquid and can deliquesce. The number of melt zones is not limited to two and can easily be up to ten or more. It is important that the substrate in the areas in which melted toner is located has no contact with a surface, for example, a transport element. Since the toner image sections melted in the respective melt zone have a clearly smaller area compared to the entire toner image area, the substrate can be supported around the melt area which is active at the time, for example, by transport elements so that slack of the substrate in the melted toner image section essentially hardly occurs and therefore the melting process and reliable continued transport of the substrate are not influenced.

BRIEF DESCRIPTION OF THE DRAWINGS

The invention and its advantages will be better understood from the ensuing detailed description of preferred embodiments, reference being made to the accompanying drawings in which like reference characters denote like parts.

DETAILED DESCRIPTION OF THE PREFERRED EMBODIMENTS

Figure 1:
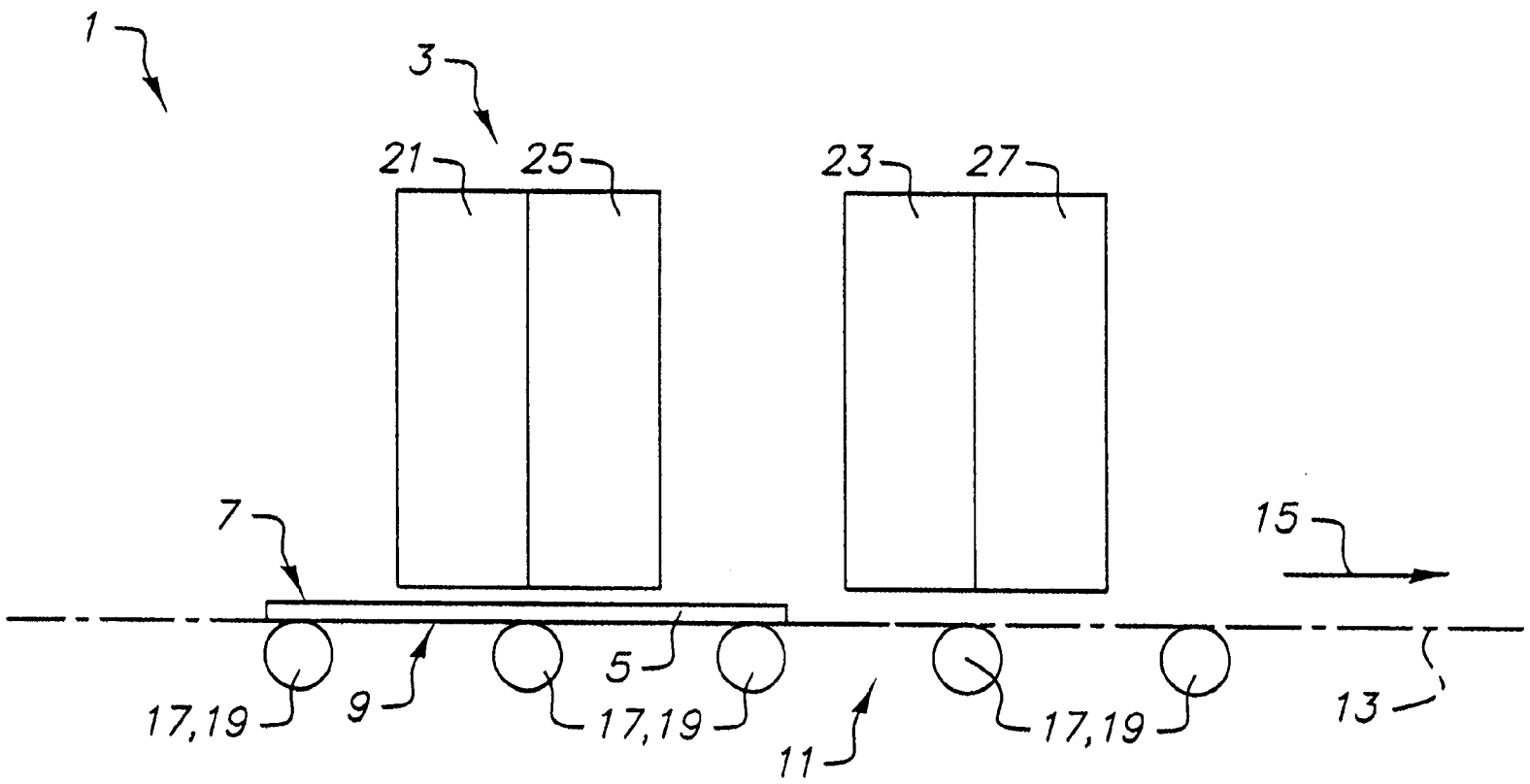
FIG. 1 shows one embodiment of the printing or copying machine of the invention in the area of the fixing device in a side view.

FIG. 1 shows a digital printing or copying machine 1, which works for example using the electrographic or electrophotographic process. The machine 1 has a fixing device 3 for fixing the toner image which has been transferred to the substrate 5. The toner image to be fixed is located here on the top 7 of the substrate 5. On the bottom 9 of the substrate there can be another, already fixed toner image. The machine 1 is therefore used for double-sided printing of the substrate 5, only one-sided printing also being easily possible.

The substrate 5 is displaced in the area of the fixing device 3 by a transport device 11 along a transport path 13 which is shown by the broken line. The substrate transport direction 15 is shown by an arrow. The substrate transport path 13 here runs to an imaginary horizontal line.

The transport device 11 has several transport elements 17 which are formed by rollers 19. The rollers 19, with a respective width which is much less than the width of the substrate 5, are arranged at a distance from one another transversely over the width of the transport path 13 and in the transport direction 15. At least some of the rollers 19 are connected to a drive which is not shown and which drives them to rotate around their lengthwise middle axis. The rollers 19 which are not connected to a drive are supported to be able to rotate. The substrate 5 rests flat on the rollers 19 which are located underneath the substrate transport path 13, is therefore supported by them, and by applying a drive moment to at least some of the rollers 19, it is pushed by them in the transport direction 15.

Above the substrate transport path 13 is the fixing device 3 past which the substrate 5 is guided. The fixing device 3 has a first heater 21 and a second heater 23 which viewed in the substrate transport direction 15 are located in succession and at a distance from one another. The heaters 21, 23 are used for contactless melting of the toner image located on the top 7 of the substrate and are made such that only individual toner image sections/strips are melted, which is detailed below with reference to FIG. 2.

The heaters 21, 23 are preferably formed by one radiation device are a time which has at least one radiator for exposing the substrate 5 to electromagnetic radiation. The radiator can be formed for example by a xenon flash lamp which emits radiation pulses or by a continuously or constantly illuminating UV lamp or an infrared radiator which continuously emit electromagnetic radiation in a certain wavelength range. Alternatively, the heaters 21, 23 are also made such that they apply hot air or steam to the substrate to melt on the toner image. In another version of the heaters 21, 23 it is provided that they expose the substrate 5 to microwave radiation. It is common to all versions of the heaters that they do not make mechanical contact with the toner image for melting.

A first cooling device 25 is assigned to the first heater 21 and the second cooling device 27 is assigned to the second heater 23. The cooling devices 25, 27 are located viewed in the transport direction directly behind the respective heater. The cooling devices 25, 27 are used to cool the toner image section which had been melted beforehand by the upstream heater.

Figure 2:
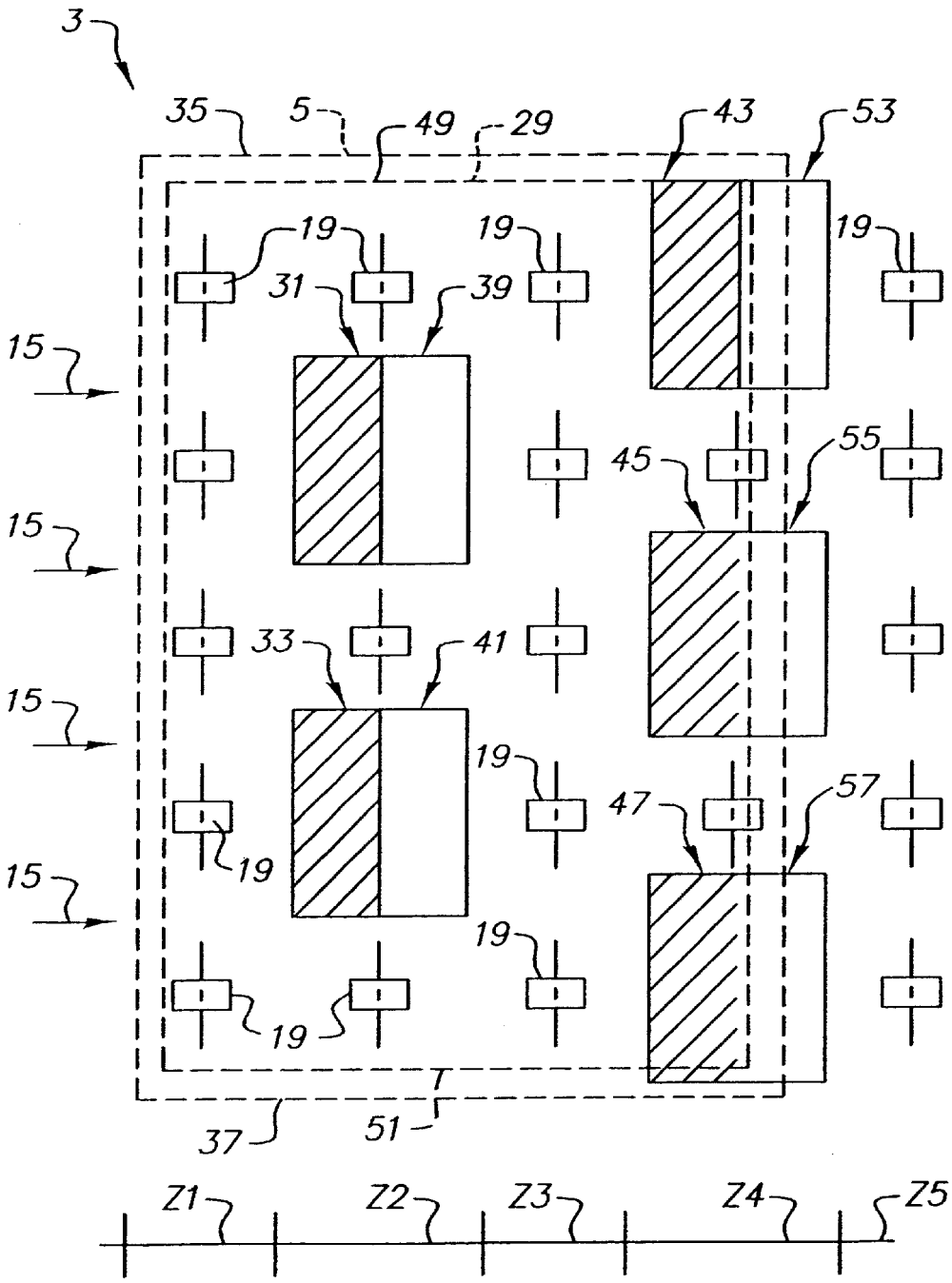
FIG. 2 shows a plan view of the transport path of the substrate in the area of the fixing device as shown in FIG. 1.

FIG. 2 shows a plan view of the transport path 13 of the substrate 5 which is shown by the broken line in the area of the fixing device 3. The toner image 29 to be fixed is indicated with a broken line. The heaters 21, 23 and the cooling devices 25, 27 are not shown in FIG. 2, but their action areas on the substrate are shown, which will be detailed below.

The fixing area of the fixing device 3 in the substrate transport direction 15 is divided into a total of five imaginary zones Z1 to Z5 which each extend over the entire width of the substrate transport path. The first heating device 21 is assigned to the second zone Z2 and has a first melt area 31 and a second melt area 33 on the substrate 5, which are rectangular. The identical melt areas 31, 33 are viewed transversely to the substrate transport direction 15 located in the middle area of the substrate transport path at a distance from one another and each at a distance from the lengthwise edge 35 and 37 of the substrate 5. In this connection a "melt area" is defined as only the lengthwise section of the toner image 29 which overlaps the melt area during displacement of the substrate 5 in the transport direction 15 being melted. Therefore only two toner image sections which have the same width as the melt areas 31, 33 are melted by the first heater 21. By displacing the substrate 5 in the transport direction 15 thus two strips of the toner image are melted. The first cooling device 25 which is assigned to the first heater 21 in the area of the second zone Z2 has cooling areas 39 and 41 which viewed in the substrate transport direction 15 lie directly behind the melt areas 31, 33. In the cooling areas 39, 41 the toner image section which had been melted beforehand is preferably cooled to such an extent that the toner images fixed on the front and back of the substrate have a solid state again when leaving the cooling area.

The second heater 23 is assigned to the fourth zone Z4 and it has a total of three melt areas 43, 45, 47 which are made identical to the melt areas 31, 33. The melt areas 43 to 47 are viewed transversely to the transport direction 15 located in succession at a distance. The melt areas 43 to 47 viewed in the substrate transport direction 15 have a lateral offset to the melt areas 31, 33 of the first heater 21, the first melt area 43 of the heater 23 being assigned to the edge of the toner image 29 near the lengthwise edge 35 of the substrate and between the first melt area 31. The width and alignment of the melt area 43 are chosen such that it overlaps the toner image edge 49 and a small part of the melt area 31. The melt area 45 is assigned to the intermediate space between the melt areas 31, 33 and overlaps the melt areas 31, 33. The melt area 47 covers the intermediate space between the melt area 33 and the toner image edge 51 and overlaps both to a small extent. The second cooling device 27 has especially three cooling areas 53, 55, and 57 which are each directly downstream of one of the melt areas 43 to 47.

FIG. 2 shows all the rollers 19 of the transport device 11. It is apparent that the rollers 19 are distributed in the area of zones Z1, Z3 and Z5 over the entire width of the toner image 29, while in zone Z2 there is only one roller 19 at a time between the melt areas and the respective toner image edge and one roller 19 between the melt areas 31, 33. In the fourth zone Z4 there are only two rollers 19 which are each located between two melt areas. It should be emphasized that viewed from overhead onto the transport path 13 underneath the melt areas 31, 33 and 43 to 47 and the cooling areas 39, 41 and 53 to 57 there are no transport elements or other guides. Therefore the substrate 5 in these areas has no contact with the surface so that a toner image which has already been fixed on the substrate bottom and which can liquefy when the toner image 29 located on the substrate top 7 melts, cannot stick anywhere.

Function of the fixing device 3: The transport device 11 preferably displaces the substrate 5 continuously with a uniform speed in the transport direction 15. As soon as the toner image 29 overlaps one of the melt areas of the heaters 21, 23, the toner image is melted in this area so that it deliquesces and is joined to the substrate. In the respective directly downstream cooling area the substrate is cooled at least to such an extent that the already fixed toner image located on the bottom of the substrate becomes solid again before it subsequently, beginning with the third zone Z3, comes into contact again with the rollers 19 of the transport device 11. Starting with the fifth zone Z5 the substrate on its front and its back can come into contact with the transport elements 17 (rollers 19) of 30 the transport device 11 since the toner image 29 is completely fixed and the toner images applied to the front and back of the substrate are cooled to such an extent that they have a solid form.

In the embodiment described with reference to FIG. 2, a total of five toner image sections which are the same width here are melted, each of the melted toner image sections slightly overlapping the adjacent toner image section so that no unfixed toner image sections remain. It becomes easily apparent that the number of melt areas and their width can be varied. The width of the melt areas and their lengthwise extension in the transport direction 15 of the substrate 5 can therefore be different. It is important that the width of all melt areas in sum is larger than the total width of the toner image and that the arrangement of the melt areas to one another and relative to the toner image 29 is adjusted such that the toner image 29 is melted over its entire width.

Figure 3:
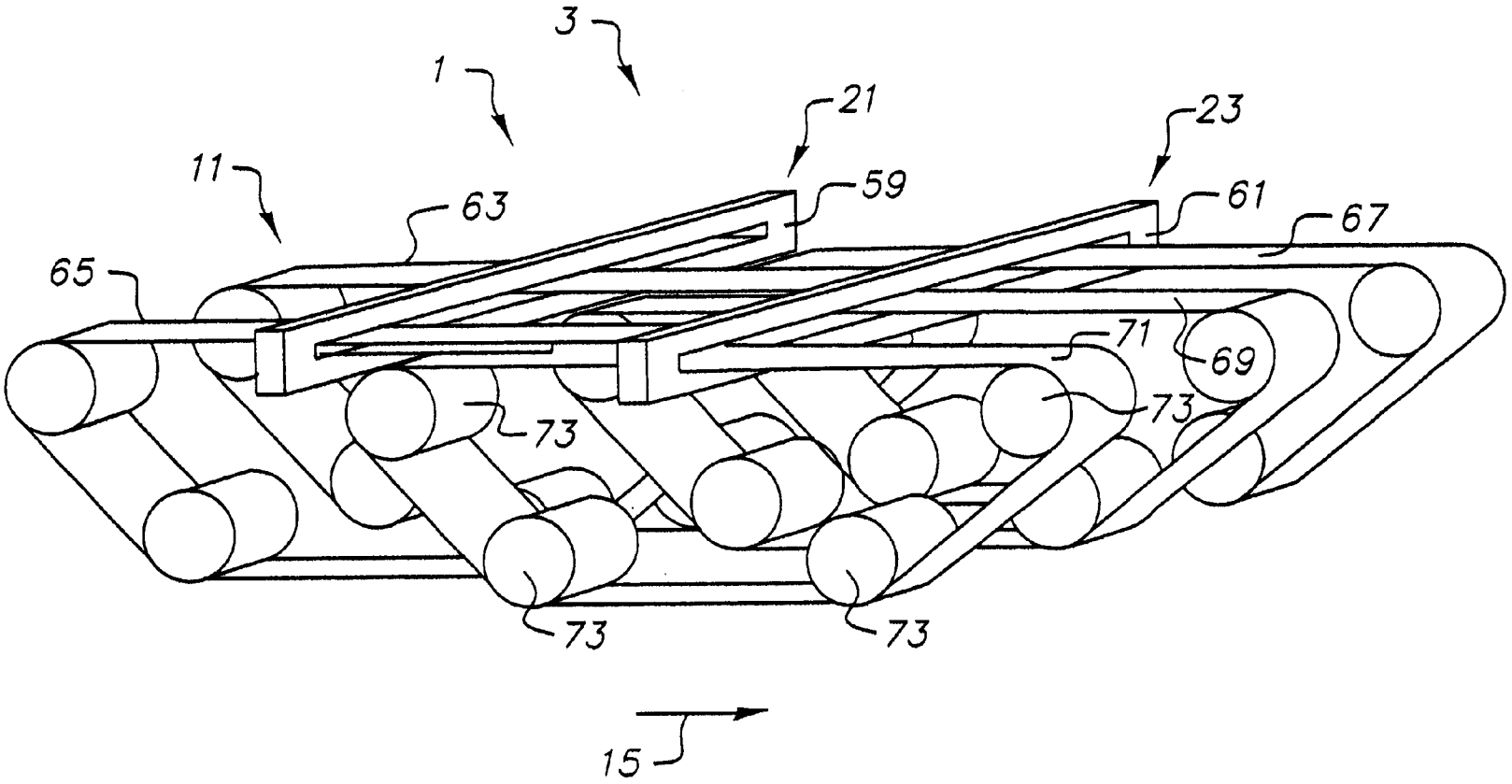
FIG. 3 shows another embodiment of the fixing device in a perspective view.

FIG. 3 shows another embodiment of the fixing device 3. The latter includes heaters 21, 23 which are each formed by a microwave resonator 59 and 61 respectively. The microwave resonators 59, 61 each have a slotted opening through which the transport path of the substrate runs. The structure and function of the microwave resonators 59, 61 is generally known, so that they are only briefly detailed below. The transport device 11 for displacement of the substrate along the transport path in the area of the fixing device 3 past the microwave resonators 59, 61 here has a total of five continuous transport belts 63 to 71 which are each guided via four guide rollers 73. The arrangement of the guide rollers 73 is chosen such that each transport belt has a transport belt section which is located between two guide rollers 73 and which runs parallel to the transport path of the substrate and on which the substrate 5 rests. This transport belt section of each of the transport belts is guided through the slotted opening of one of the microwave resonators 59, 61 at a time. As FIG. 3 shows, the transport belts 63, 65 are assigned to the microwave resonator 59 and the transport belts 67, 69 and 71 are assigned to the microwave resonator 61, i.e. the transport belts 63, 65, are not guided through the microwave resonator 61 and the transport belts 67 to 71 are not guided through the microwave resonator 59. The transport belts 63 to 71 are arranged with a lateral offset to one another, viewed in the substrate transport direction 15.

The microwave resonators 59, 61 are operated in the $H_{10N}$ mode. This mode forms a regular pattern of the microwave radiation with areas of maximum and minimum intensity transversely to the transport direction of the substrate. The minimum and maximum intensity can be set such that the toner is not melted in the areas in which the microwave radiation has a minimum intensity, while the toner is melted in the desired manner in the areas in which the microwave radiation has maximum intensity. With reference to the invention therefore each microwave resonator has a number of melt areas on the substrate which are arranged viewed transversely to the 11 transport direction in succession with a distance to one another, the melt areas of the first microwave resonator 59 and those of the second microwave resonator 61 viewed in the substrate transport direction being laterally offset to one another and preferably overlapping one another so that the entire toner image is melted. It is provided according to the invention that the width of each of the transport belts 63 is smaller than the width of the areas of microwave radiation in which it has a minimum. The arrangement of the transport belts within the fixing device, especially transversely to the substrate transport direction, is chosen such that the transport belts run through the areas of the microwave resonator in which the microwave radiation has minimum intensity. This ensures that when the toner image to be fixed is melted, the already fixed toner image which is located on the bottom of the substrate and which adjoins the transport belts 63, 65 or 67 to 71 is not melted in its contact areas with the transport belts.

Figure 4:
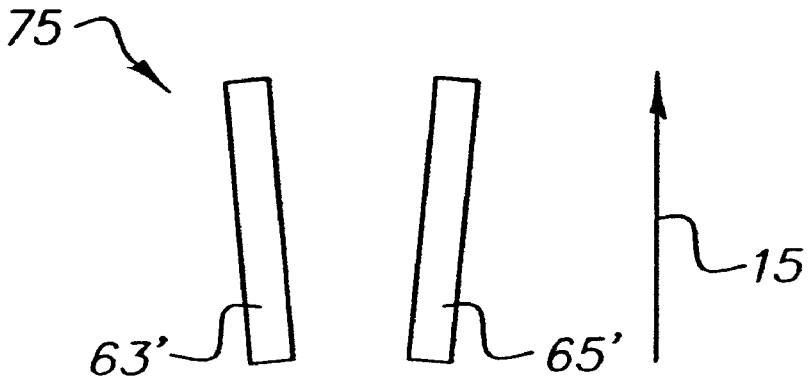
FIGS. 4 and 5 each show embodiment of a pulling device for applying a tensile stress to the substrate, in a plan view.

The substrate path or paper path can also be implemented by at least two of the transport belts not running exactly parallel to the substrate transport direction 15, but at a slight angle to the feed or substrate transport direction 15, as is apparent from FIG. 4, which shows a plan view of the substrate transport path. FIG. 4 shows only the transport belts 63' and 65'. The angle of the transport belts 63', 65' is such that the transport belts run away from the center of the substrate path, i.e. the transport belts 63, 65 run apart. In this way the substrate, which is not shown in FIG. 4, is always kept under tensile stress. Of course, forces applied to the substrate which rests on the transport belts 63', 65' are only so large that the substrate is not damaged, for example, torn. As a result of the divergence of the transport belts 63', 65' a pulling device 75 for applying tensile stress to the substrate is implemented. Furthermore, the transport belts 63', 65' can be made for example as an electrostatic transport belt or negative pressure transport belt which can be suctioned.

Figure 5:
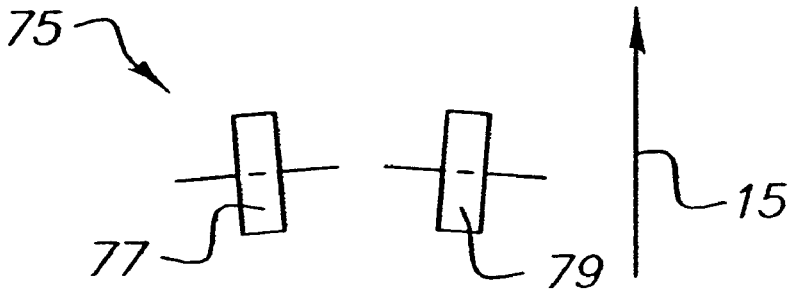

FIG. 5 shows another embodiment of the pulling device 75 which instead of transport belts has transport rollers 77 and 79 which are arranged in a manner similar to the transport belts 63', 65' described with reference to FIG. 4. This means that the transport rollers 77 and 79 are each inclined relative to the substrate transport direction such that the substrate lying thereon is exposed to tensile stress.

In another version of the pulling device which is not shown, there is at least one pair of rollers which are pressed against one another or which have a short distance to one another, the substrate transport path passing through the nip formed between the rollers. At least one of the rollers is provided with a drive. In this embodiment it is important that the unfixed toner image is not disturbed. This can be done for example by the upper roller which possibly comes into contact with the toner image being made of a low adhesion material, for example Teflon®, or being coated with Teflon®.

It is provided in one preferred embodiment that at least some of the transport elements of the transport device 11 and/or the pulling device are coated with a separating material or consist of it. The separating material has the property that even softened toner preferably does not adhere to it, but at least the adhesive forces are only so little that reliable separation of the substrate from the transport element can be ensured.

A cleaning mechanism can be associated with the transport elements which come into contact with the substrate or the unfixed toner image which has been transferred to it.

The transport device 11 for displacing the substrate 5 within the fixing device 3 along its transport path, alternatively or instead of the rollers 19 or transport belts 63 to 71 described with reference to FIGS. 1 to 3, can also include electrostatically charged transport belts and/or suction belts which can be exposed to a negative pressure. Of course it is also possible for the transport device 11 to have several different transport elements, for example, both rollers and also belts.

The fixing device 3 which is described with reference to FIGS. 1 to 3 requires exact guidance of the substrate 5 so that the melt areas of the heaters overlap one another. If the overlapping is too small, the toner image has areas with unfixed toner. If the overlapping is too large, areas of the toner image are fixed twice, i.e. repeatedly melted; this can lead to a nonuniform gloss of the toner image. It is therefore provided in one advantageous embodiment, which is not shown in the figures, that the fixing device is upstream of a finishing apparatus by which a uniform gloss is established over the entire toner image. The finishing apparatus can for example have a heater with at least one hot roller with which the toner image to be treated is brought into contact.

The process of this invention easily follows from the description of the figures. The process calls for the toner image which has been transferred to the substrate side to be melted in sections, in the first melt zone at least the first toner image section being melted and in the second melt zone spaced in the substrate transport direction at least the second toner section being melted. In the embodiment described with reference to FIGS. 1 and 2 the first melt zone is in the area of zone Z2 and the second melt zone is in the area of zone Z4. The at least two melt zones viewed in the substrate transport direction are arranged laterally offset to one another and overlap one another so that the toner image is completely melted and fixed when it passes the last of the melt zones. It becomes clear that the number of melt zones can easily be greater than two, that is, can be three, four, or five. It is important that in the area of the melt zones, the liquefied toner image section has no contact with the surface.

The embodiments should not be understood as a limitation of the invention. Rather, within the framework of this disclosure numerous modifications and changes are possible, especially those versions, elements and combinations and/or materials which for example by combination or modification can be taken from individual features or elements for process steps which are contained in the drawings and which are described in the general specification and embodiments and the claims, for one skilled in the art with respect to achieving the object, and lead to a new subject matter or new process steps or sequences of process steps by combinable features.

The invention has been described in detail with particular reference to certain preferred embodiments thereof, but it will be understood that variations and modifications can be effected within the spirit and scope of the invention.

| Parts List | |
|---|---|
| 1 | printing and copying machine |
| 3 | fixing device |
| 5 | substrate |
| 7 | top |
| 9 | bottom |
| 11 | transport device |
| 13 | transport path |
| 15 | transport direction |
| 17 | transport element |
| 19 | roller |
| 21 | 1st heater |
| 23 | 2nd heater |
| 25 | 1st cooling means |
| 27 | 2nd cooling means |
| 29 | toner image |
| 31 | 1st melt area |
| 33 | 2nd melt area |
| 35 | lengthwise edge |
| 37 | lengthwise edge |
| 39 | cooling area |
| 41 | cooling area |

-continued

| Parts List | |
|---|---|
| 43 | melt area |
| 45 | melt area |
| 47 | melt area |
| 49 | edge of toner image |
| 51 | edge of toner image |
| 52 | cooling area |
| 55 | cooling area |
| 57 | cooling area |
| 59 | microwave resonator |
| 61 | microwave resonator |
| 63 | transport elements |
| 65 | transport elements |
| 67 | transport elements |
| 69 | transport elements |
| 71 | transport elements |
| 73 | guide roller |
| 75 | pulling device |
| 77 | transport roller |
| 79 | transport roller |

What is claimed is:

1. Printing or copying machine (1) for one-sided or double-sided printing of a substrate (5) using at least one toner, with at least one fixing device (3) for fixing of a toner image (29) on the substrate (5), the fixing device (3) having at least one heater (21, 23) for melting the toner image (29), past which the substrate (5) can be guided by a transport device (11) which has several transport elements (19, 63 to 71), said fixing device characterized in that said heater (21, 23) has at least two melt areas (31, 33, 43 to 47) on the substrate (5) which viewed in the substrate transport direction (15), are arranged in succession and laterally offset to one another, and at least one cooling device (25, 27) for cooling the substrate (5) and/or the melted toner image (2), wherein at least one cooling area (39, 41, 53 to 57) of the cooling device (25, 27), on the substrate (5), at a time is directly downstream of each melt area (31, 33, 43, 45, 47) of the heater (21, 23), wherein viewed in the substrate transport direction (15) the width of the melt area (31, 33, 43, 45, 47) and the width of the cooling area (39, 41, 53 to 57) are the same.

2. Printing or copying machine according to claim 1, wherein viewed in the substrate transport direction (15) the width of the respective melt area (31, 33, 43, 45, 47) is smaller than the total width of the toner image (29) which is to be melted.

3. Printing or copying machine according to claim 1, wherein the melt areas (31, 33, 43, 45, 47) overlap one another on the toner image (29) which is to be fixed.

4. Printing or copying machine according to claim 1, wherein the fixing device (3) has at least two heaters (21, 23) which each have at least one melt area (31, 33, 43, 45, 47) on the substrate (5).

5. Printing or copying machine according to claim 1, wherein the transport elements (17, 63 to 71) are arranged distributed around the melt areas (31, 33, 43, 45, 47) of the heater (21, 23) and around at least one cooling area (39, 41, 53 to 57) of the cooling device (25, 27).

6. Printing or copying machine according to claim 5, wherein the transport elements (17, 63 to 71) are located above and/or below the substrate transport path (13), which runs preferably parallel to an imaginary horizontal line.

7. Printing or copying machine according to claim 1, characterized by a pulling device which is associated with the fixing device (3) for applying a tensile stress to the substrate (5).

8. Printing or copying machine according to claim 7, wherein at least some of the transport elements of the transport device and/or of the pulling device include a separating material.

* * * * *